US007999646B2

(12) United States Patent
Minamidate

(10) Patent No.: US 7,999,646 B2
(45) Date of Patent: Aug. 16, 2011

(54) COMPOSITE MAGNETIC DEVICE

(75) Inventor: Satoshi Minamidate, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/680,600

(22) PCT Filed: Sep. 12, 2008

(86) PCT No.: PCT/JP2008/066555

§ 371 (c)(1),
(2), (4) Date: Mar. 29, 2010

(87) PCT Pub. No.: WO2009/041301

PCT Pub. Date: Apr. 2, 2009

(65) Prior Publication Data

US 2010/0214051 A1 Aug. 26, 2010

(30) Foreign Application Priority Data

Sep. 27, 2007 (JP) ..... 2007-251447

(51) Int. Cl.
*H01F 27/02* (2006.01)

(52) U.S. Cl. ..... 336/83

(58) Field of Classification Search ..... 336/65, 336/83, 212, 220–223
See application file for complete search history.

(56) References Cited

U.S. PATENT DOCUMENTS

| | | | | |
|---|---|---|---|---|
| 4,314,221 | A * | 2/1982 | Satou et al. | 336/83 |
| 5,751,203 | A * | 5/1998 | Tsutsumi et al. | 336/65 |
| 6,747,538 | B2 * | 6/2004 | Kuwata et al. | 336/83 |
| 6,850,142 | B2 * | 2/2005 | Saito et al. | 336/192 |
| 7,259,650 | B2 | 8/2007 | Sano | |
| 2006/0290458 | A1 | 12/2006 | Sano | |

FOREIGN PATENT DOCUMENTS

| | | | |
|---|---|---|---|
| CN | 1892932 | A | 1/2007 |
| JP | 56-32414 | | 3/1981 |
| JP | 6-26227 | U | 4/1994 |
| JP | 2002-170721 | A | 6/2002 |
| JP | 2007-12686 | A | 1/2007 |
| KR | 10-2007-0001010 | A | 1/2007 |
| WO | 03/043034 | A1 | 5/2003 |

OTHER PUBLICATIONS

Supplementary European search report for Application No./Patent No. 08833251.5-2208 / 2197003 dated Oct. 25, 2010.
International Search Report for International Application No. PCT/JP2008/066555 mailed Dec. 9, 2008 with English translation.

* cited by examiner

*Primary Examiner* — Tuyen Nguyen
(74) *Attorney, Agent, or Firm* — Cantor Colburn LLP

(57) ABSTRACT

To provide a composite magnetic device having characteristics of two magnetic elements, being capable of reducing a manufacturing cost, and preferably enabling the respective magnetic elements to easily exhibit the same characteristics. The composite magnetic device includes: a first core member which includes an outer tube portion having a tubular shape and a partition portion partitioning an inner space (P) of the outer tube portion into two inner spaces; second core members each including a first flange portion and a second flange portion, the second core members being arranged in a state in which a magnetic gap is formed at least between the partition portion and the second flange portion, and being arranged in each of the two inner spaces (P) on each side of the partition portion; coils each arranged on a spool portion present between the first flange portion and the second flange portion; and terminal members arranged on an outer peripheral surface of the outer tube portion and electrically connected to ends of the coils.

9 Claims, 3 Drawing Sheets

COMPOSITE MAGNETIC DEVICE

CROSS REFERENCE

This is a U.S. national stage application of International Application No. PCT/JP2008/066555 filed on 12 Sep. 2008. Priority under 35 U.S.C. §119(a) and 35 U.S.C. §365(b) is claimed from Japanese Application No. 2007-251447, filed 27 Sep. 2007, the disclosure of which is also incorporated herein by reference.

TECHNICAL FIELD

The present invention relates to a composite magnetic device used for portable music equipment, various audiovisual (AV) equipment, electronic equipment such as TV.

RELATED ART

In a digital audio amplifier used for various AV equipment such as TV or audio equipment, for example, there is installed a composite magnetic device including two magnetic elements as described in Patent Document 1. In the composite magnetic device described in Patent Document 1, a drum core (first core) is covered with a pot-type core (second core), and further, an outside of the pot-type core (second core) is covered with a pot-type core (third core) having a larger diameter than that of the second core.

Patent Document 1: JP 2002-170721 A (see Abstract, FIG. 1, and the like)

DISCLOSURE OF THE INVENTION

Problems to be Solved by the Invention

By the way, the above-mentioned composite magnetic device uses the second core and the third core, and hence separate molds are required to manufacture the second core and the third core. Further, each of the second core and the third core needs to be wound with a coil separately, and hence there arises a problem in that its manufacturing cost is increased. Further, in a structure of Patent Document 1, in many cases, it is preferred that two inductors have the same characteristics. However, in the structure of Patent Document 1, in order that the two inductors have the same characteristics, there are needs for adjusting the winding number, and adjusting dimensions and the like.

The present invention has been made in view of the above-mentioned circumstances, and therefore, it is an object of the present invention to provide a composite magnetic device having characteristics of the two magnetic elements, the composite magnetic device being capable of reducing the manufacturing cost, and preferably enabling the respective magnetic elements to easily exhibit the same characteristics.

Means for Solving the Problems

In order to solve the above-mentioned problems, the present invention provides a composite magnetic device including: a first core member which includes an outer tube portion having a tubular shape and a partition portion partitioning an inner space of the outer tube portion into two inner spaces; second core members each including a first flange portion and a second flange portion, each of the second core members being arranged in a state in which a magnetic gap is formed at least between the partition portion and the second flange portion, and being arranged in each of the two inner spaces on each side of the partition portion; coils each arranged on a spool portion present between the first flange portion and the second flange portion; and terminal members arranged on an outer peripheral surface of the outer tube portion and electrically connected to ends of the coils.

In a case of structuring as described above, the inner space of the first core member is divided into two inner spaces by the partition portion, and the second core members are arranged in the divided inner spaces, respectively. Further, magnetic fluxes generated in the coils present in the respective second core members flow, in a state in which the magnetic fluxes do not influence with each other, into an inside of the first core member and the second core members. Thus, two magnetic elements exist in an independent state. Thus, using one composite magnetic device according to the present invention equals mounting two magnetic elements on a substrate, and hence the number of the magnetic elements can be reduced. Further, the partition portion is provided in the inner space of the first core member, and hence it is possible to prevent a magnetic coupling from occurring between the two coils. In addition, the magnetic gap is provided in the inside of the first core member, and hence magnetic leakage to an outside is hard to occur in comparison with a case where the magnetic gap is exposed to the outside.

Further, in another invention, in addition to the above-mentioned invention, the first flange portion has an outline of a surface which is substantially orthogonal to an axial direction of the outer tube portion, the outline of the first flange portion containing an outline on an inner peripheral side of an end surface of the outer tube portion. Further, the first flange portion is fixed to the end surface of the outer tube portion so as to be held in surface contact with the end surface of the outer tube portion.

In a case of structuring as described above, the inner space of the first core member is in a state of being covered with the first flange portion. Thus, due to the first flange portion, it is possible to prevent fluxes generated from the coils from leaking to the outside. Further, positioning of the partition portion, the second flange portion, and the magnetic gap is facilitated.

In addition, in another invention, in addition to each of the above-mentioned inventions, the magnetic gap functions as a first clearance S separating the partition portion and the second flange portion from each other, the second flange portion and an inner wall surface of the outer tube portion also have a second clearance T therebetween, and a dimension of the first clearance S is provided so as to be larger than a dimension of the second clearance T.

In a case of structuring as described above, the dimension of the first clearance S is larger than the dimension of the second clearance T. Thus, a flow of the magnetic flux at the partition portion becomes smaller than a flow of the magnetic flux between the inner wall surface of the outer tube portion and the second flange portion. Thus, the partition portion is hard to be magnetically saturated. Further, due to the presence of the first clearance S and the second clearance T, the composite magnetic device of the present invention is capable of obtaining a higher direct-current-superposed characteristic in comparison with a case where the first clearance S and the second clearance T do not exist.

In addition, in another invention, in addition to each of the above-mentioned inventions, the surface substantially orthogonal to the axial direction of the outer tube portion of the first flange portion is identical in shape to a surface substantially orthogonal to the axial direction of the outer tube portion of the second flange portion.

In a case of structuring as described above, both of the first flange portion and the second flange portion are allowed to have the second clearance T between the inner wall surface of the outer tube portion. In this case, it is possible to obtain the second clearance T smaller than the clearance T of the flanges each having a different shape of the surface substantially orthogonal to the axial direction of the outer tube portion. At the same time, it is possible to enlarge both of the first flange portion and the second flange portion. Thus, it is possible to increase a winding diameter (outer periphery) of the coil, and hence it is possible to reduce a discharge resistor (DCR).

In addition, in another invention, in addition to each of the above-mentioned inventions, the outer tube portion is provided with at least two engaging protrusions on an end surface around each opening portion of the outer tube portion. In a case of structuring as described above, it is possible to engage outer peripheral surfaces of upper flange portions of the second core members arranged in the inner space of the outer tube portion with the engaging protrusions. Thus, it is possible to stably fix the second core members into the inner space of the outer tube portion.

In addition, in another invention, in addition to each of the above-mentioned inventions, engaging protrusions are provided at positions opposite to the terminal members arranged on the outer peripheral surface of the outer tube portion based on the axial direction in the outer tube portion. In a case of structuring as described above, the engaging protrusions are arranged at positions on a terminal member side of the composite magnetic device, on which a mounting substrate is arranged, and on an opposite side thereof, respectively. Thus, the ends of the coils are easily picked up from the composite magnetic device so as to be connected to another member.

In addition, in another invention, in addition to each of the above-mentioned inventions, each of the terminal members includes: a mounting portion having a flat-plate shape; a side-surface engaging portion folded from the mounting portion in a perpendicular direction; and an end-connecting portion. In a case of structuring as described above, as long as a shape of the cross-section of the outer tube portion is a substantially rectangular shape, each of the terminal members can be stably arranged at a corner of the outer periphery of the outer tube portion.

Further, the present invention provides a composite magnetic device, including: a first core member provided with concave portions formed at both ends of a pillar-shaped member, respectively; second core members each including a winding shaft portion and flanges formed at both ends of the winding shaft portion; and coils each wound around the winding shaft portion, in which the second core members are respectively arranged in the concave portions provided in both end portions of the first core member.

In a case of structuring as described above, the second core members are arranged in the concave portions independently provided in the first core member. Further, magnetic fluxes generated in the coils present in the respective second core members flow, in a state in which the magnetic fluxes do not influence with each other, into an inside of the first core member and the second core members. Thus, the two magnetic elements exist in an independent state. Thus, using one composite magnetic device according to the present invention equals mounting two magnetic elements on a substrate, and hence the number of the magnetic elements can be reduced. Further, the independent concave portions are provided in the first core member, and hence it is possible to prevent a magnetic coupling from occurring between the two coils.

EFFECTS OF THE INVENTION

According to the present invention, in a composite magnetic device having characteristics of two magnetic elements, it is possible to reduce the manufacturing cost. Further, it is possible for the two magnetic elements to easily exhibit the same characteristics.

DESCRIPTION OF THE SYMBOLS

Figure 1:
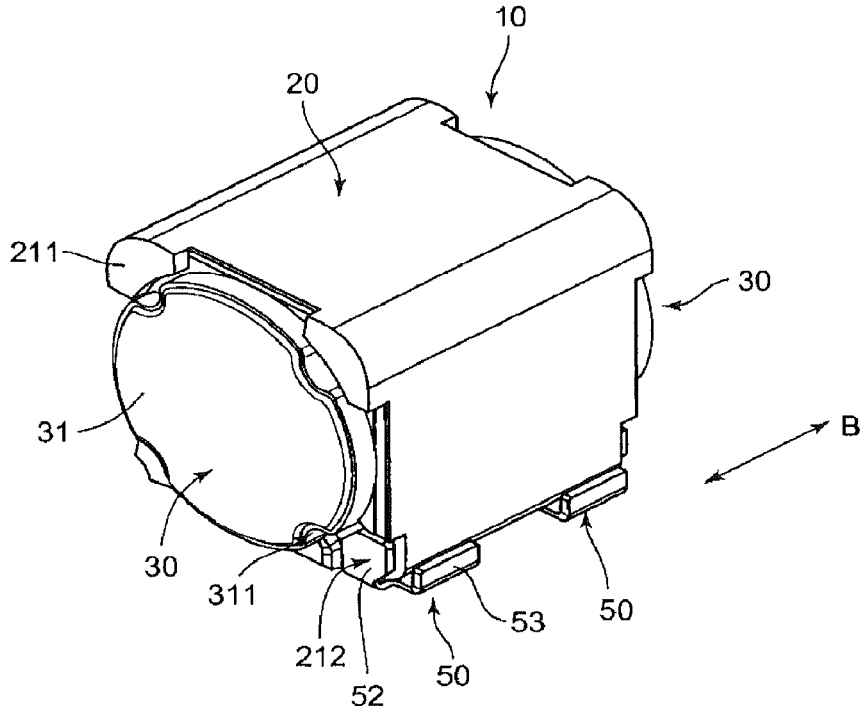
[FIG. 1] A perspective view which illustrates a structure of a composite magnetic device according to one embodiment of the present invention, and illustrates a state of the composite magnetic device viewed from above.

10 composite magnetic device
20 pot core (corresponding to first core member)
21 outer tube portion
22 partition portion
30 drum-type core (corresponding to second core member)
31 upper flange portion (corresponding to first flange portion)
32 column-shaped leg portion
33 lower flange portion (corresponding to second flange portion)
40 coil
50 mounting terminal (corresponding to terminal member)
51 mounting portion
52 end-connecting portion
53 side-surface engaging portion
212 recessed portion for induction
S, T clearance

BEST MODE FOR CARRYING OUT THE INVENTION

In the following, a composite magnetic device 10 according to one embodiment of the present invention is described with reference to FIGS. 1 to 6.

As illustrated in FIGS. 1 to 5 etc, the composite magnetic device 10 of this embodiment has functions of two magnetic elements. The composite magnetic device 10 includes one pot core 20, two drum-type cores 30, two coils 40, and four (in total) mounting terminals 50.

Of the above-mentioned components, the pot core 20 is formed of a nickel-based ferrite, for example. However, a material for the pot core 20 is not limited to the above-mentioned material, and may include a variety of magnetic materials (for example, a variety of ferrites, permalloys, sendust, or the like). The pot core 20 corresponds a first core member, and includes an outer tube portion 21 and a partition portion 22. In other words, the pot core 20 is provided with two concave portions formed at both ends of a pillar-shaped member, the partition portion 22 serving as a common bottom surface of the two concave portions.

As illustrated in FIG. 1, the outer tube portion 21 is a tubular member having a square-shape appearance. The outer tube portion 21 is provided with an engaging protrusion 211 and a recessed portion for induction 212. Of those components, the engaging protrusion 211 is a portion engaging with an outer peripheral surface 31*a* of an upper flange portion 31 of each of the drum-type cores 30. On an outer peripheral side of the engaging protrusion 211, the engaging protrusion 211 is provided so as to be flush with an outer peripheral surface 21*a*. Meanwhile, on an inner peripheral side of the engaging protrusion 211, the engaging protrusion 211 is provided so as to have a curved surface corresponding to the upper flange portion 31. Further, two engaging protrusions 211 are provided. The two engaging protrusions 211 are provided at corners of the outer peripheral surface 21*a*, respectively, the corners being situated on a side opposite to a side which is mounted to a substrate (side to which the mounting terminals 50 are fixed) with respect to an axial direction of the outer tube portion 21.

Figure 2:
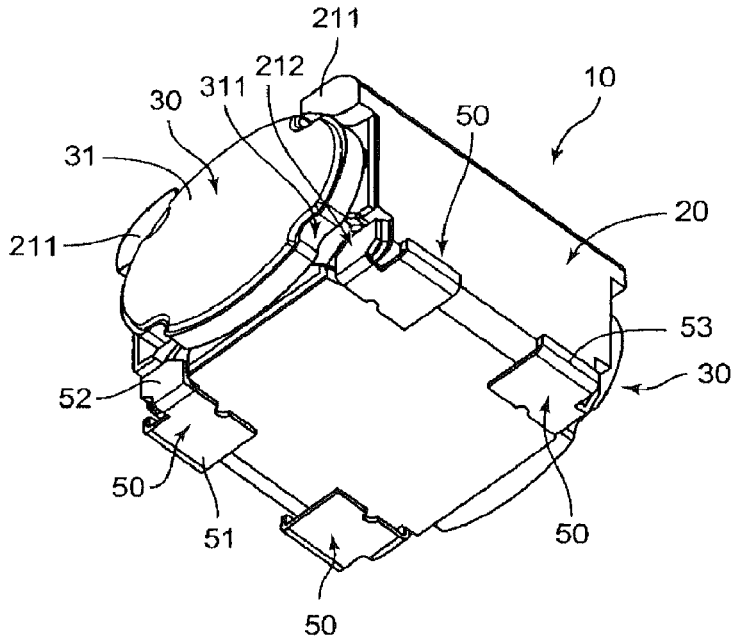
[FIG. 2] A perspective view illustrating a state of the composite magnetic device of FIG. 1 viewed from below.
Figure 5:
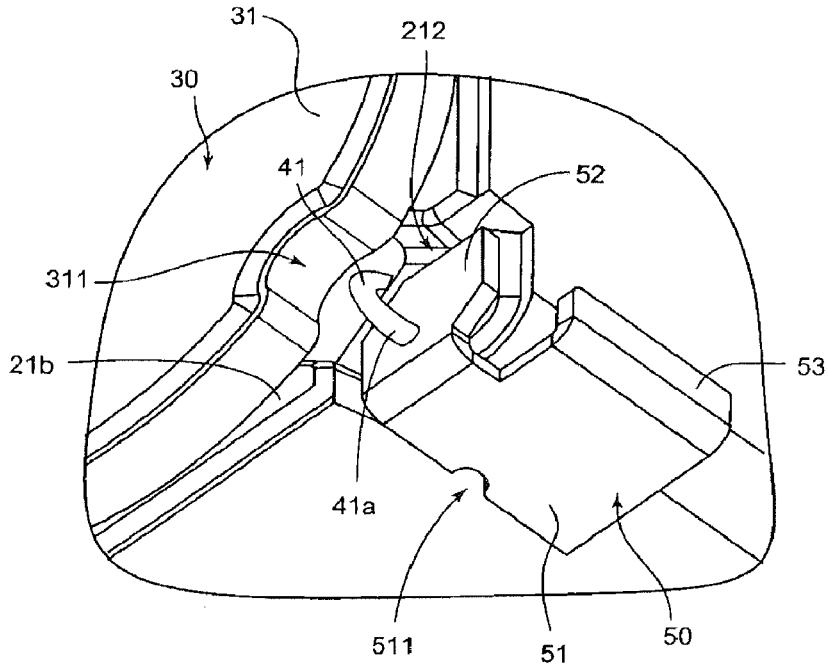
[FIG. 5] A partially enlarged view illustrating a structure of a vicinity of recessed portions for induction in the composite magnetic device of FIG. 1.

Further, the recessed portion for induction 212 is a portion at which the mounting terminals 50 to be described later are situated. As illustrated in FIGS. 2, 5, and the like, two recessed portions for induction 212 are provided. The two recessed portions for induction 212 are provided at corners of the outer peripheral surface 21*a*, respectively, the corners being situated on the side which is mounted to a substrate (side to which the mounting terminals 50 are fixed). Further, the recessed portions for induction 212 are provided so as to be recessed from an end surface 21*b*, with which lower surfaces 31*b* of the upper flange portions 31 come into contact, of the outer tube portion 21. With the recessed portions for induction 212, end-connecting portions 52 of the mounting terminals 50 are engaged. Further, from the recessed portions for induction 212, terminals 41*a* of the coils 40 present inside of the pot core 20 are pulled out. Further, the pulled-out terminals 41*a* are mounted and fixed to the end-connecting portions 52 by soldering or the like.

Figure 3:
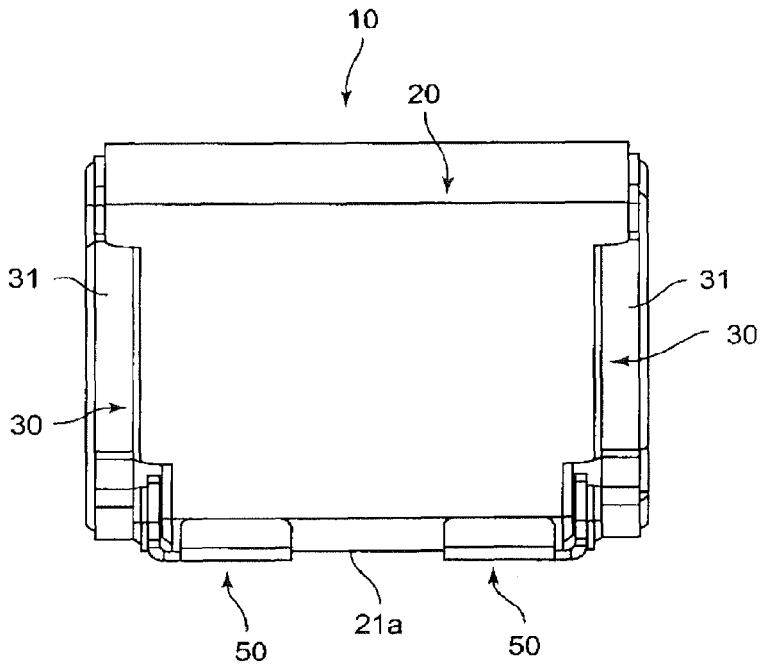
[FIG. 3] Aside view illustrating a state of the composite magnetic device of FIG. 1 viewed from a side thereof.

Note that, though, in FIG. 1 and the like, the engaging protrusions 211 and the recessed portions for induction 212, which are present only in an end surface 21*b* on one side of the outer tube portion 21, are illustrated, the similar engaging protrusions 211 and recessed portions for induction 212 are present also in an end surface 21*b* on another side of the outer tube portion 21 (see FIG. 3). The engaging protrusions 211 and the recessed portions for induction 212, which are present in the end surface 21*b* on the another side, and the engaging protrusions 211 and the recessed portions for induction 212, which are present in the end surface 21*b* on the one side, are present in the identical outer peripheral surface 21*a*. Therefore, the four (in total) mounting terminals 50 are present on the mounting side of the composite magnetic device 10.

Figure 4:
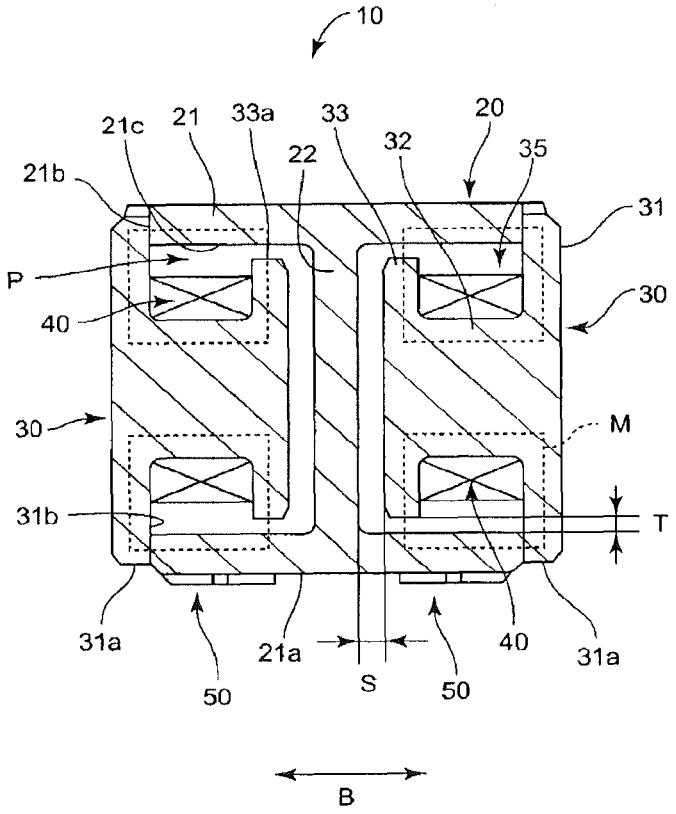
[FIG. 4] A cross-sectional view illustrating a state of the composite magnetic device of FIG. 1 taken along a direction of the arrow B.

Further, as illustrated in FIG. 4, in a substantially center portion in the arrow B direction of FIG. 4 of the pot core 20, the partition portion 22 is present. The partition portion 22 has a plate-shape section in which the arrow B direction serves as a normal direction thereof. The partition portion 22 divides a cylindrical inner space P of the pot core 20 into two inner spaces P. Therefore, in FIG. 4, the pot core 20 exhibits a substantially H-shape cross-section. The partition portion 22 is provided so as to have the same thickness dimension as that of the outer tube portion 21. However, the partition portion 22 may be structured so as to have a thickness dimension larger than that of the outer tube portion 21.

Further, each of the drum-type cores 30 corresponds a second core member. For example, the drum-type core 30 is formed of the same nickel-based ferrite as the pot core 20. However, similarly, a material for the drum-type core 30 is not limited to a nickel-based ferrite, and may include a variety of magnetic materials (may include the same materials as those for the pot core 20 and different materials from those for the pot core 20). In an example of selection of different materials from those for the pot core 20, the pot core 20 may be formed of a nickel-based ferrite, and the drum-type core 30 may be formed of a manganese-based ferrite. In that combination, a better direct-current-superposed characteristic of each of the magnetic elements in the composite magnetic device 10 is allowed.

Each of the drum-type cores 30 includes the upper flange portion 31, a column-shaped leg portion 32 (winding shaft portion), and a lower flange portion 33. Of those components, the upper flange portion 31, the column-shaped leg portion 32, and the lower flange portion 33 are provided so as to have circular planes. Further, the upper flange portion 31 of the drum-type core 30 is provided so as to have a larger diameter than that of the lower flange portion 33. The upper flange portion 31 corresponds to a first flange portion. The upper flange portion 31 has such a diameter that the lower surface 31*b* abuts against the end surface 21*b* without entering the inner space P. Further, the upper flange portion 31 is provided with cutout portions 311. The cutout portions 311 are portions recessed in a state of forming a substantially semi-circle toward a center side of the upper flange portion 31 in a radial direction. Note that, in this embodiment, the upper flange portion 31 is provided with four (in total) cutout portions 311 at 90 degrees intervals.

Further, as illustrated in FIG. 4, the drum-type cores 30 are arranged in concave portions (in FIG. 4, inner spaces denoted by reference symbol P) which are provided at both ends of the pot core 20. Here, the lower flange portions 33 correspond to second flange portions and are portions arranged on a most-center side in the inner spaces P. Each of the lower flange portions 33 is provided, in a state in which the lower surface 31*b* of the upper flange portion 31 is in contact with the end surface 21*b*, so as to have a certain clearance S (in FIG. 4, portion of space of dimension S) with respect to the partition portion 22. That is, the lower flange portion 33 is provided in non-contact with the partition portion 22 so as to have the clearance S, and the clearance S functions as a magnetic gap. Further, the clearance S corresponds to a first clearance. Further, the lower flange portion 33 is provided in non-contact also with an inner peripheral wall surface 21*c* of the outer tube portion 21. That is, between an outer peripheral surface 33*a* of the lower flange portion 33 and the inner peripheral wall surface 21*c* of the outer tube portion 21, a clearance T (in FIG. 4, portion of space of dimension T) is provided. Further, the clearance T corresponds to a second clearance. The clearance T functions also as a magnetic gap.

Figure 6:
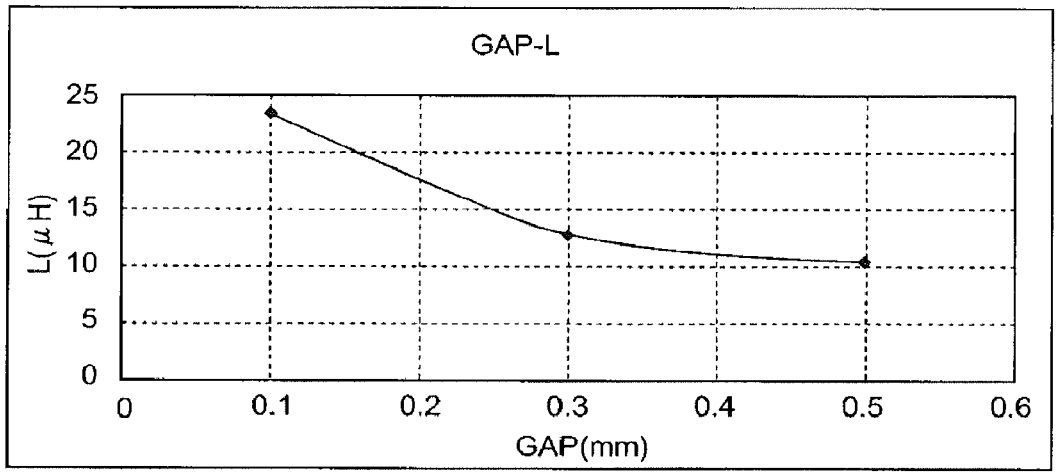
[FIG. 6] A graph illustrating a relation between a gap and an inductance value in the composite magnetic device of FIG. 1.

Note that, in this embodiment, the above-mentioned clearance S is provided so as to be larger than the clearance T. Thus, a magnetic path M illustrated in FIG. 4 is in a state of mainly passing through the clearance T. Further, the clearance S is set to be a region in which variation of an inductance value is small if some inequality of dimension arises. An example thereof is illustrated in FIG. 6. In the example illustrated in FIG. 6, in a case where the dimension of the clearance S is set to 0.45 mm, even if variation of dimension occurs by ±0.05 mm, the variation of the inductance value is about 1 μH, that is, the inductance value is restricted so as to be small.

Further, a portion of an outside of the column-shaped leg portion 32 between the upper flange portion 31 and the lower flange portion 33 is provided with a spool portion 35. As illustrated in FIG. 4, on the spool portion 35, the coil 40 is arranged. The coil 40 is formed by winding a winding wire 41. Note that, the winding wire 41 is a wire such as enamel wire, an outer peripheral portion of which is covered with an insulating coating. Further, the winding wire 41 is a lead having a substantially circular cross-section. However, the cross-section of the winding wire 41 is not limited to the substantially circular cross-section, and a ribbon wire (flat wire) having an elongated cross-section may be used.

Further, as illustrated in FIG. 5 and the like, of the pot core 20, to the outer peripheral surface 21*a* on a side on which the pair of recessed portions for induction 212 are present, the mounting terminals 50 are fixed. The mounting terminals 50 correspond to terminal members, and are portions which are punched into a predetermined shape and folded by pressing of a metal plate. Each of the mounting terminals 50 includes a mounting portion 51 having a flat-plate shape, the end-connecting portion 52, and a side-surface engaging portion 53. Of those components, the mounting portion 51 is a portion electrically connected to the mounting substrate. Note that, in this embodiment, the mounting portion 51 has a portion of the mounting portion 51 being a substantially rectangular shape, and a portion of the mounting portion 51 extending from the rectangular portion toward the end-connecting portion 52 is provided so as to have a smaller width dimension than that of another portion. Further, the mounting portion 51 is provided with a recessed portion 511 cutout into a substantially semi-circular shape.

Further, the end-connecting portion 52 is perpendicularly folded so as to form substantially 90 degrees with the mounting portion 51. The end-connecting portion 52 is, in this embodiment, provided so as to have a smaller area than that of the mounting portion 51. Further, the end-connecting portion 52 is fixed so as to be held in surface contact with the above-mentioned recessed portion for induction 212. To the end-connecting portion 52, an end 41*a* of the winding wire 41 is electrically connected by means of soldering, welding, or the like. Further, the side-surface engaging portion 53 is also perpendicularly folded so as to form substantially 90 degrees with the mounting portion 51. Due to such folding, the side-surface engaging portion 53 protrudes in the same direction as the end-connecting portion 52. In this case, normal lines of the mounting portion 51, the end-connecting portion 52, and the side-surface engaging portion 53 are provided in a state of being substantially orthogonal to each other. The side-surface engaging portion 53 is a portion which is engaged with the outer peripheral surface 21*a* adjacent to the outer peripheral surface 21*a* in which the pair of recessed portions for induction 212 is present. Further, the mounting portion 51 comes into surface contact with an one-side outer peripheral surface 21*a*, the side-surface engaging portion 53 comes into surface contact with the outer peripheral surface 21*a* adjacent to the one-side outer peripheral surface 21*a*, and, in addition, the end-connecting portion 52 comes into surface contact with the recessed portion for induction 212. In this way, positioning of the mounting terminal 50 is performed.

Note that, the mounting portion 51 is mounted and fixed to the outer peripheral surface 21*a* of the pot core 20 by the means of an adhesion or the like.

According to the composite magnetic device 10 having the above-mentioned structure, when current is conducted to the winding wire 41, a magnetic flux is generated to the coil 40. In this case, the magnetic path M passes, as illustrated in FIG. 4, through the drum-type core 30 and the pot core 20. In this case, as illustrated in FIG. 4, the dimension of the clearance T is provided so as to be smaller than the dimension of the clearance S. Thus, the magnetic path M (magnetic flux) passes mainly through a portion of the clearance T. Therefore, through the partition portion 22, so large magnetic flux does not pass. As a result, even when current is conducted to each composite magnetic device 10, a magnetic saturation hardly occurs at the partition portion 22.

Further, due to the presence of the partition portion 22, each of the magnetic fluxes generated through the two coils 40 flows, in a state in which the magnetic fluxes do not influence with each other, into an inside of the pot core 20 and the drum-type cores 30. Therefore, between the two coils 40, it is possible to restrict a magnetic coupling from occurring. Thus, the composite magnetic device 10 is in a state of including separate two magnetic elements. Therefore, using one composite magnetic device 10 according to the present invention equals mounting the two magnetic elements on the substrate, and hence the number of the magnetic elements can be reduced.

Further, in this embodiment, the magnetic gap is provided to the inside of the pot core 20, and hence magnetic leakage to an outside is hard to occur in comparison with a case where the magnetic gap is exposed to the outside.

In addition, in this embodiment, the upper flange portion 31 is provided in a disk shape having a larger diameter than that of the lower flange portion 33. The upper flange portion 31 is fixed so as to be held in surface contact with the end surface 21*b* of the outer tube portion 21. Thus, the inner space P of the pot core 20 is in a state of being covered with the upper flange portion 31. It is possible to prevent to a large extent a flux generated from the coil 40 from leaking to the outside.

Further, in this embodiment, the dimension of the clearance S is provided so as to be larger than a dimension of the clearance T. Thus, the magnetic flux flows mainly via the clearance T between the inner peripheral wall surface 21*c* of the outer tube portion 21 and the lower flange portion 33. Thus, a flow of the magnetic flux via the clearance S becomes smaller, and the partition portion 22 is hard to be magnetically saturated. Further, due to the presence of the clearance S and the clearance T, the composite magnetic device 10 of the present invention is capable of obtaining a higher direct-current-superposed characteristic in comparison with a case where the clearance S and the clearance T do not exist.

Further, in the composite magnetic device 10, the two drum-type cores 30 have the same shape. Thus, separate molds are not required differently from a case where the two pot-shaped cores (second core and third core) are formed into shapes different from each other as disclosed in Patent Document 1. Accordingly, it is possible to reduce the manufacturing cost. In addition, in this embodiment, the two drum-type cores 30 are formed of the same material, and hence the two drum-type cores 30 are capable of having the same characteristics if the coils 40 provided to the respective wiring frame portions 35 are wound the same number of times. Therefore, even in a case where it is preferred that the two magnetic elements have the same characteristics, there is no need for adjusting the winding number, and adjusting dimensions of the drum-type cores 30 and the like.

Further, in this embodiment, the composite magnetic device 10 uses the drum-type cores 30. Here, each of the drum-type cores 30 includes the upper flange portion 31 and the lower flange portion 33, and consequently, each of the drum-type cores 30 includes the spool portion 35 surrounded by the upper flange portion 31, the lower flange portion 33, and the column-shaped leg portion 32. Thus, winding of the winding wire 41 is easy, and it is possible to easily form the coil 40 to the spool portion 35. Further, in the above-mentioned drum-type core 30, winding of the winding wires 41 having various diameters is easy, and it is possible to extend an obtaining range of an inductance value.

In the foregoing, though the composite magnetic device 10 according to one embodiment according to the present invention, the present invention may include various modifications other than the above-mentioned embodiment. In the following, description thereof is made.

In the above-mentioned embodiment, the clearance S is provided as the magnetic gap between the lower flange portion 33 and the partition portion 22, and the clearance T is provided as the magnetic gap also between the lower flange portion 33 and the inner peripheral wall surface 21*c*. However, the magnetic gap is not limited to those clearance S and clearance T. For example, an additional material, such as a metal plate formed of copper or the like, a seat member made of a resin, or an adhesive, maybe interposed at least one of between the lower flange portion 33 and the partition portion 22 and between the lower flange portion 33 and the inner peripheral wall surface 21*c*, to thereby be used as the magnetic gap.

Further, in the above-mentioned embodiment, in the drum-type core 30, an outline of a surface substantially orthogonal to an axial direction of the outer tube portion 21 of the upper flange portion 31 includes an outline of a surface substantially orthogonal to an axial direction of the outer tube portion 21 of the lower flange portion 33. Further, such relation is achieved by setting a diameter of the upper flange portion 31 to be larger than a diameter of the lower flange portion 33. However, a shape of the surface substantially orthogonal to the axial direction of the outer tube portion 21 of the upper flange portion 31 may be formed so as to be substantially the same as a shape of the surface substantially orthogonal to the axial direction of the outer tube portion 21 of the lower flange portion 33. In this case, the diameter of the upper flange portion 31 and the diameter of the lower flange portion 33 may be set to be substantially identical to each other. Note that, in a case of structuring as described above, between the upper flange portion 31 and the inner peripheral wall surface 21*c*, use of an adhesive or an additional fixture is needed.

Further, in the above-mentioned embodiment, the pot core 20 is integrally molded. However, the pot core is not limited to that integrally molded. For example, a plate-shaped core (corresponding to the partition portion) maybe interposed between two ring-cores, and the plate-shaped core and each of the two ring-cores are abutted against to each other to thereby structure the pot core.

In addition, in the above-mentioned embodiment, the partition portion 22 is not limited to a case of being provided in the direction of the arrow B of the pot core 20. As long as the partition portion 22 is capable of dividing the inner space P, the partition portion 22 may be provided at any position.

Further, the composite magnetic device 10 in the above-mentioned embodiment is used for a digital audio amplifier, for example. However, application of the composite magnetic device 10 is not limited thereto. Various applications are possible, such as use for a choke in electric powered equipment, for example.

INDUSTRIAL APPLICABILITY

The composite magnetic device according to the present invention can be applied to the field of the electric powered equipment.

The invention claimed is

1. A composite magnetic device, comprising:

a first core member comprising an outer tube portion having a tubular shape and a partition portion partitioning an inner space of the outer tube portion into two inner spaces;

second core members each comprising a first flange portion and a second flange portion, each of the second core members being arranged in a state in which a magnetic gap is formed at least between the partition portion and the second flange portion, and arranged in each of the two inner spaces on each side of the partition portion;

coils each arranged on a spool portion present between the first flange portion and the second flange portion; and terminal members arranged on an outer peripheral surface of the outer tube portion and electrically connected to ends of the coils.

2. A composite magnetic device according to claim 1, wherein:

the first flange portion has an outline of a surface which is substantially orthogonal to an axial direction of the outer tube portion, the outline of the first flange portion containing an outline on an inner peripheral side of an end surface of the outer tube portion; and the first flange portion is fixed to the end surface of the outer tube portion so as to be held in surface contact with the end surface of the outer tube portion.

3. A composite magnetic device according to claim 1, wherein:

the magnetic gap functions as a first clearance (S) separating the partition portion and the second flange portion from each other;

the second flange portion and an inner wall surface of the outer tube portion also have a second clearance (T) therebetween; and a dimension of the first clearance (S) is provided so as to be larger than a dimension of the second clearance (T).

4. A composite magnetic device according to claim 1, wherein the surface substantially orthogonal to the axial direction of the outer tube portion of the first flange portion is identical in shape to a surface substantially orthogonal to the axial direction of the outer tube portion of the second flange portion.

5. A composite magnetic device according to claim 1, wherein the outer tube portion is provided with at least two engaging protrusions on an end surface around each opening portion of the outer tube portion.

6. A composite magnetic device according to claim 5, wherein the engaging protrusions are provided at positions opposite to the terminal members arranged on the outer peripheral surface of the outer tube portion based on the axial direction in the outer tube portion.

7. A composite magnetic device according to claim 1, wherein each of the terminal members comprises:

a mounting portion having a flat-plate shape;

a side-surface engaging portion folded from the mounting portion in a perpendicular direction; and an end-connecting portion.

8. A composite magnetic device, comprising:

a first core member provided with concave portions formed at both ends of a pillar-shaped member, respectively;

second core members each comprising a winding shaft portion and flanges formed at both ends of the winding shaft portion; and coils each wound around the winding shaft portion, wherein the second core members are respectively arranged in the concave portions provided in both end portions of the first core member.

9. A composite magnetic device according to claim 2, wherein the surface substantially orthogonal to the axial direction of the outer tube portion of the first flange portion is identical in shape to a surface substantially orthogonal to the axial direction of the outer tube portion of the second flange portion.

* * * * *